US011634822B2

(12) United States Patent
Amaya et al.

(10) Patent No.: US 11,634,822 B2
(45) Date of Patent: Apr. 25, 2023

(54) SYSTEMS AND METHODS FOR PROVIDING MONITORED AND CONTROLLED CATHODIC PROTECTION POTENTIAL

(71) Applicant: OneSubsea IP UK Limited, London (GB)

(72) Inventors: Herman Amaya, Houston, TX (US); Behrang Fahimi, The Woodlands, TX (US); Manfred Hartwig, Houston, TX (US); Tobias Voelkel, Houston, TX (US)

(73) Assignee: ONESUBSEA IP UK LIMITED, London (GB)

( * ) Notice: Subject to any disclaimer, the term of this patent is extended or adjusted under 35 U.S.C. 154(b) by 279 days.

(21) Appl. No.: 16/118,495

(22) Filed: Aug. 31, 2018

(65) Prior Publication Data

US 2019/0085468 A1 Mar. 21, 2019

Related U.S. Application Data

(60) Provisional application No. 62/558,998, filed on Sep. 15, 2017.

(51) Int. Cl.
*C23F 13/16* (2006.01)
*E21B 41/00* (2006.01)
(Continued)

(52) U.S. Cl.
CPC ..... *C23F 13/16* (2013.01); *C23F 13/04* (2013.01); *C23F 13/14* (2013.01); *C23F 13/18* (2013.01);
(Continued)

(58) Field of Classification Search
CPC .. C23F 13/02–13/22; C23F 2213/30–2213/32; E02B 17/0026; B63B 59/04
See application file for complete search history.

(56) References Cited

U.S. PATENT DOCUMENTS 438,198 A 10/1890 Spangler
2,903,405 A 9/1959 Sabins
(Continued)

FOREIGN PATENT DOCUMENTS

CA 2879225 A1 7/2016
EP 1775462 A2 * 4/2007 ..... C23F 13/04
(Continued)

OTHER PUBLICATIONS

Extended European search report issued in European patent appl. No. 18191956.4 dated Jan. 30, 2019; 8 pages.
(Continued)

*Primary Examiner* — Alexander W Keeling
(74) *Attorney, Agent, or Firm* — Eileen Pape

(57) ABSTRACT

An intelligent system is provided for monitoring a subsea structure and delivering appropriate cathodic protection to desired areas of the subsea structure. According to an embodiment, the technique involves monitoring a cathodic protection potential level at an important location or locations of the subsea structure. Based on the data acquired via monitoring, a controller is able to apply voltage levels to the subsea structure so as to attain and modulate a desired cathodic protection level, e.g. a cathodic protection level within a range of about −800 mV to −950 mV (SCE). Consequently, undesirable overprotection and under protection are avoided and the subsea structure is adequately protected from corrosion while reducing undesirable production of hydrogen.

11 Claims, 8 Drawing Sheets

(51) Int. Cl.

| | |
|---|---|
| ***C23F 13/04*** | (2006.01) |
| ***C23F 13/14*** | (2006.01) |
| ***C23F 13/22*** | (2006.01) |
| ***C23F 13/18*** | (2006.01) |

(52) U.S. Cl.
CPC ..... *C23F 13/22* (2013.01); *E21B 41/0007* (2013.01); *C23F 2213/20* (2013.01); *C23F 2213/21* (2013.01); *C23F 2213/31* (2013.01)

(56) References Cited

U.S. PATENT DOCUMENTS

| | | | | |
|---|---|---|---|---|
| 3,303,118 | A | 2/1967 | Anderson | |
| 3,360,452 | A | 12/1967 | McNulty | |
| 3,769,521 | A * | 10/1973 | Caldwell | C23F 13/04 204/196.03 |
| 3,870,615 | A * | 3/1975 | Wilson | C23F 13/02 204/196.18 |
| 4,740,106 | A * | 4/1988 | Bianchi | C23F 13/18 405/211 |
| 5,350,494 | A | 9/1994 | Brummelhuis | |
| H1644 | H * | 5/1997 | Muehl, Sr. | C23F 13/04 204/196.05 |
| 5,627,414 | A * | 5/1997 | Brown | C23F 13/22 204/196.03 |
| 7,044,075 | B2 | 5/2006 | Sica et al. | |
| 7,285,203 | B2 * | 10/2007 | Russell | C23F 13/04 205/725 |
| 8,118,983 | B1 * | 2/2012 | Anderson | C23F 13/04 204/196.11 |
| 8,154,296 | B2 * | 4/2012 | Guo | C23F 13/04 324/425 |
| 8,607,878 | B2 | 12/2013 | Knox | |
| 9,353,446 | B2 | 5/2016 | Mulcahy et al. | |
| 2004/0031697 | A1 * | 2/2004 | Breault | C23F 13/02 205/724 |
| 2008/0105562 | A1 | 5/2008 | Simpson et al. | |
| 2009/0065367 | A1 | 3/2009 | Heselmans | |
| 2010/0270169 | A1 | 10/2010 | Howard et al. | |
| 2011/0000794 | A1 | 1/2011 | Nelvig et al. | |
| 2011/0089047 | A1 * | 4/2011 | Jensen | C22C 18/04 205/724 |
| 2012/0152559 | A1 | 6/2012 | Knox | |
| 2015/0299868 | A1 * | 10/2015 | Sergi | C23F 13/20 205/730 |

FOREIGN PATENT DOCUMENTS

| | | | |
|---|---|---|---|
| GB | 826824 | A | 1/1960 |
| GB | 2535847 | A | 8/2016 |

OTHER PUBLICATIONS

Examination Report issued in European patent application No. 18191956.4 dated May 20, 2021; 5 pages.

* cited by examiner

SYSTEMS AND METHODS FOR PROVIDING MONITORED AND CONTROLLED CATHODIC PROTECTION POTENTIAL

CROSS-REFERENCE TO RELATED APPLICATION

The present document is based on and claims priority to U.S. Provisional Application Ser. No. 62/558,998, filed Sep. 15, 2017, which is incorporated herein by reference in its entirety.

BACKGROUND

Cathodic protection with sacrificial anodes has been used as a method of preventing and controlling corrosion in marine and subsea environments. The sacrificial anodes are constructed to corrode and passivate a surface of a base metal structure to which they are attached, thus protecting the structure from corrosion. The sacrificial anodes may be made from magnesium, zinc, or aluminum alloys which have a more negative electrochemical potential with respect to the base metal they are protecting. For example, an aluminum-indium anode has an electrical open circuit potential of −1050 mV (SCE-standard calumel reference electrode) and corrodes preferentially when coupled to a carbon alloy steel that normally has an electrical potential of approximately (−600 to −700) mV (SCE). Sacrificial anodes can be constructed to last 20-30 years depending on environmental variables and on the total mass of the anodes that are installed. However, use of sacrificial anodes can be problematic in a variety of applications due to the difficulty of distributing the anodes to desired locations throughout the metal structure. This, in turn, can result in a condition where some areas of the metal structure are overprotected while other areas are under protected. Overprotection may lead to cathodic disbondment of the coatings, resulting in accelerated deterioration of the anode as it compensates for the additional area to be protected. The overprotection also can lead to excess hydrogen generation which can cause excessive saturation or diffusion of hydrogen into the exposed metal of the metal structure.

Other approaches have been attempted but such approaches have similarly proved problematic in a variety of applications, such as subsea applications. For example, impressed current cathodic protection systems have been employed and utilize a power source combined with anodes that distribute protective currents. In subsea operations, however, existing impressed current cathodic protection systems incur power losses associated with delivering rectified DC power to a distribution point that can be thousands of feet underwater. The power losses can lead to a lack of uniformity in distribution of the current flow which, again, can create overprotection in some parts of the structure and under protection in other parts. Closely related to this is an additional difficulty associated with incorporating impressed current systems into subsea oil and gas production operations. The additional difficulty results during initial positioning of subsea equipment in place without connection to electrical power. Without active cathodic protection, the metals without barrier coatings would be exposed to the corrosive conditions of the surrounding seawater in that interim period before active power is available to drive the cathodic protection system. Potential power outages during service also could compromise the entire system.

SUMMARY

In general, a system and methodology provide an intelligent closed-loop system for monitoring and control of a cathodic protection system. For example, on an oil and gas subsea production or drilling structure, the closed-loop system may be used to mitigate power outages and to promote delivery of appropriate cathodic protection to desired areas of the subsea structure even if the availability of power is interrupted or otherwise affected. According to an embodiment, the technique involves monitoring a cathodic protection potential level at an important, e.g. susceptible, location or locations of the subsea structure. Based on the data acquired via monitoring, a controller is able to apply voltage levels to the subsea structure so as to attain and modulate a desired cathodic protection level, e.g. a cathodic protection level within a range of about −800 mV to −950 mV (SCE). Consequently, undesirable overprotection and under protection are avoided and the subsea structure is adequately protected from corrosion while reducing undesirable production of hydrogen.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
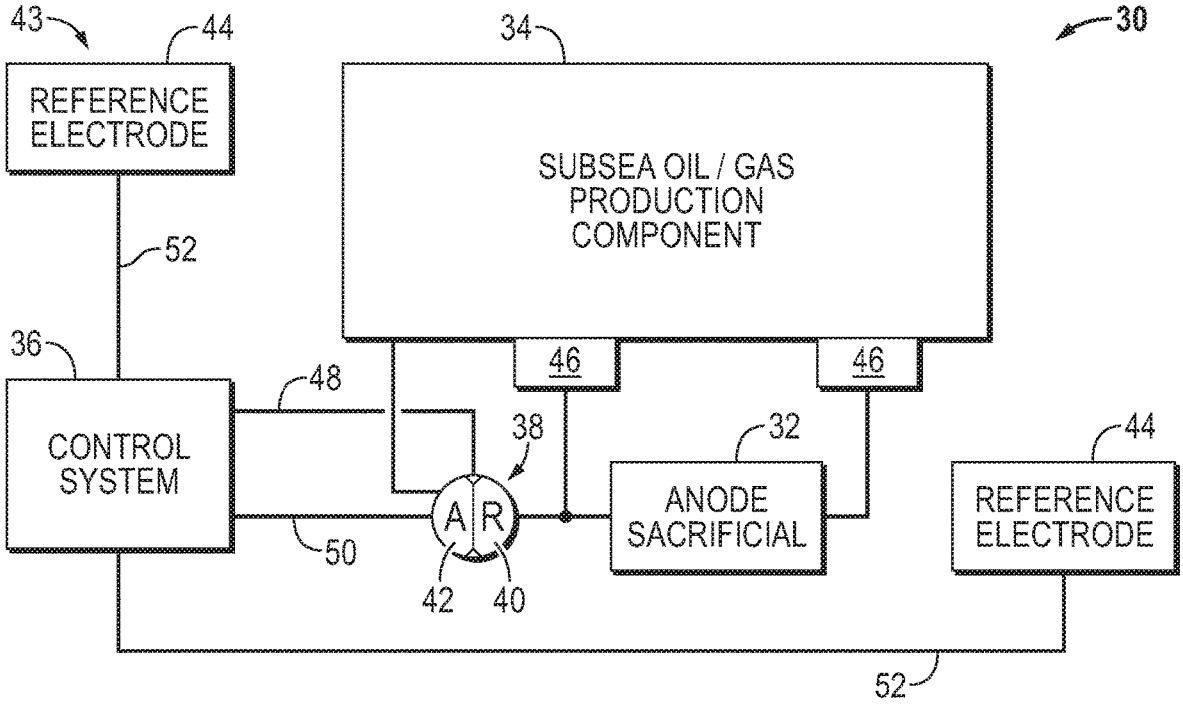
FIG. 1 is a schematic illustration of an example of closed-loop control and monitoring of a modulated current sacrificial anode cathodic protection system, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The present disclosure generally relates to a system and methodology related to an intelligent system for monitoring a subsea structure and delivering appropriate cathodic protection to desired/important areas of the subsea structure. For example, on an oil and gas subsea production or drilling structure, a closed-loop intelligent system may be used to mitigate power outages and to promote delivery of appropriate cathodic protection to desired areas of the subsea structure even if the availability of power is interrupted or otherwise affected. In many applications, the subsea structure will be constructed in whole or in part from metal materials, e.g. steel materials. According to an embodiment, the technique involves monitoring a cathodic protection potential level at a location or locations of the subsea structure. A variety of sensors, e.g. reference electrodes, may be used for monitoring.

Based on the data acquired via monitoring, a controller is able to apply voltage levels to the subsea structure so as to attain and modulate a desired cathodic protection level, e.g. a cathodic protection level within a range of about −800 mV to −950 mV (SCE). The controller may comprise various types of individual controllers or combinations of controllers depending on the specifics of a given application. By way of example, the controller may comprise current controllers, processor-based controllers, programmable logic controllers, and/or other suitable controllers positioned on or near the subsea structure or at other suitable location or locations. By utilizing the monitoring and control, undesirable overprotection and under protection are reduced or avoided. Consequently, the subsea structure is adequately protected from corrosion, thus also reducing undesirable production of hydrogen which can result in embrittlement of portions of the subsea structure.

The problematic effects of overprotection or over-polarization of base metal structures can create various problems in the structure, including hydrogen embrittlement. The electrical passivation currents flowing to bare-metal areas of the subsea structure dissociate water at the metal/water interface and, in the process, generate a certain quantity of hydrogen. The higher the electric potential, the greater the relative generation of hydrogen and the greater the opportunity for diffusion into the base metal of the subsea structure. The point of greatest vulnerability of the metal material with respect to embrittlement may occur at an initial polarization voltage of −1050 mV (SCE) where the greatest amount of hydrogen may be generated. Susceptible materials can act as a micro structural trap for the diffused hydrogen (e.g. banding or hard spots), and this condition of trapped hydrogen can act as a stress riser which, in turn, can lead to rapid brittle fracture. The lag time between the initiation of a sacrificial anode and the time it reaches structural polarization is a very sensitive period with respect to the occurrence of hydrogen embrittlement.

The protection potential for stainless steels and nickel alloys is less than for carbon alloy steels. For example, the actual potential voltages vary from −300 mV to −650 mV for nickel alloys to −750 mV (SCE) for stainless steels so such alloys are sensitive to excessive hydrogen diffusion into the base metal. The consequence of designing a cathodic protection system at the production potential for the weakest link material is that exposed stainless steels and nickel alloys tend to become more overprotected than the carbon alloy steels. Exposure to this overprotection can cause these alloys to become susceptible to premature failure due to excessive saturation of hydrogen even when these alloys are in their optimal material condition and free of any optically visible microstructural traps or flaws.

Referring generally to FIG. 1, an embodiment of a cathodic protection system 30 is illustrated. This type of system provides a sacrificial anode cathodic protection system with the capability of controlling electric potential. As explained in greater detail below, this type of embodiment utilizes anodes, e.g. zinc, magnesium, aluminum, or other suitable anodes. The anodes may be combined with a current regulating device to modify the current coming from the anodes, a feedback device, and a connection system to deliver the modified current back to the subsea structure being protected. The embodiment may utilize a variable resistor chosen for a specific range of power output and regulated by a controller, e.g. a multi-channel programmable logic controller, that will also feedback data based on potential readings from at least one reference electrode, e.g an SCE or Ag/AgCl reference electrode. The protective passivation potential may, in this way, be equalized and continuously monitored by the controller inputs as opposed to using passive measurement of potential drops.

This type of sacrificial anode cathodic protection system controls the protective electrical current output of the anodes to maintain the production potential between preset ranges. Controlling and monitoring the current output from the sacrificial anodes also may cause the deterioration of the anode to be decreased substantially by allowing for a reduction in the mass of anodes used to protect a subsea structure for a desired time period, e.g. 20 to 30 years. By controlling and monitoring the protection potential within preset ranges, is also possible to reduce the risk for hydrogen embrittlement due to excessive generation of hydrogen at the base metal interface.

Control of current flow and the protective potential may be achieved via various embodiments described herein. In some applications, an anode or anodes may be electrically connected to a current regulator which may be in the form of a variable resistor. Resistance may be varied under the direction of a controller, e.g. a programmable logic controller (PLC), which responds to feedback from a group of arranged reference electrodes placed close to the protected surfaces. This type of system also utilizes at least one connection terminal used to complete the circuit and to activate a current flow with a controller modulated protective electric potential voltage to the protected base structure that is targeted for corrosion production. The result will be a subsea production structure that is protected via the use of sacrificial anodes between a definite set of protective potentials, e.g. protective potentials of −800 mV to −950 mV (SCE).

The sacrificial anode cathodic protection system reduces the risk of hydrogen embrittlement and enhances the life of the anode. In various applications, this may be achieved by uniformly distributing anodes throughout the subsea equipment and continuously monitoring the power output to achieve a protective potential of, for example, between −800 mV and −950 mV (SCE). Limiting the power output to the designated levels avoids the risk of over/under protecting as well as the deleterious oversaturation by hydrogen with respect to the exposed base metal of the subsea structure.

Additionally, the sacrificial anode cathodic protection system may be constructed as a modular system which can easily be scaled up and installed on an entire subsea structure, e.g. a subsea tree, a subsea manifold, or a blowout preventer (BOP). Each of these structures may be controlled by a suitable controller, e.g. a multi-channel PLC, that gives feedback to each of the modular sections. The modularity enables monitoring and controlling with respect to a variety of anode placements and areas of the subsea structure to be protected. The modular system approach also may be utilized in impressed current cathodic protection systems described herein.

Referring again to the embodiment illustrated in FIG. 1, a schematic illustration is provided of cathodic protection system 30. Cathodic protection system 30 comprises at least one sacrificial anode 32 and the system may be modular to enable, for example, uniform distribution throughout a subsea structure 34. The system is constructed to enable regulation of current flow generated by the sacrificial anode or anodes 32 so as to establish the protection potential ranges between, for example, −800 mV and −950 mV as determined by a reference electrode or electrodes 44, e.g. Ag/AgCl or SCE reference electrodes.

In this embodiment, the at least one anode 32 is coupled with the subsea structure 34 and with a control system 36, e.g. a programmable logic controller or other suitable controller. The control system 36 may comprise or be coupled with a control device 38 having, for example, a current regulator/variable resistor 40 and a meter 42, e.g. an ammeter. Additionally, the control system 36 is coupled with a monitoring system 43 having at least one reference electrode 44, e.g. a plurality of reference electrodes 44 which may be in the form of SCE reference electrodes.

The illustrated system provides a closed loop system able to provide current flow to the base subsea structure 34 which is the protected system. Part of the current flow is directed through the control system 36 to the at least one reference electrode 44 where the actual potential is measured and monitored as a function of the current flow. This measured potential can then be compared to the preset limits in the control system 36 so that inputs can be sent back to the variable resistor 40 to adjust current flow from anode 32 to specific connection regions 46 of subsea structure 34. In this manner, protective potentials can be continuously monitored and controlled throughout the subsea structure 34. In some embodiments, the connection regions 46 comprise isolation flanges by which the anode 32 is coupled with subsea structure 34.

With additional reference to FIG. 1, a control wire 48 may be coupled between the control system 36 and variable resistor 40 to drive inputs into the variable resistor 40 for adjusting current flow based on data monitoring of the reference electrodes 44 by the control system 36. Additionally, a feedback wire 50 may be coupled between the ammeter 42 and the control system 36 to monitor the current load to the protected subsea structure 34 and to provide input into the reference electrodes 44. This enables current draw to be correlated to an electrical potential.

Reference electrode feedback wires 52 may be connected between the reference electrodes 44 and the control system 36 to feedback the electrical potential that is being generated by the current from the sacrificial anode or anodes 32. The reference electrodes 44 may be used to comparatively monitor the systems passivation potential against a known standard, e.g. against SCE reference electrodes. This is done to ensure the current that is being generated by the sacrificial anode(s) 32 is sufficient to passivate the exposed metal of subsea structure 34. Results from the reference electrode measurements are reported back to the control system 36 via the reference electrode feedback wires 52.

In this example, the variable resistor 40 is used as a current regulator although other types of current regulators 40 may be employed to modify current flow in accordance with a specific range of preset electric potentials. The function of ammeter 42 is to directly measure the current flow that is being adjusted to match the desired preset protective potentials of, for example, −800 mV to −950 mV (SCE).

Depending on the application, the sacrificial anode or anodes 32 may be made from an aluminum-indium alloy developed to deteriorate galvanically over an extended time frame of, for example, 20-30 years. Such anodes have an activation potential of approximately −1050 mV (SCE) when initially immersed in seawater and ultimately settled down to a passivation level of, for example, −800 mV (SCE) as the anode deteriorates and as calcareous deposition forms on the bare metal of subsea structure 34. The cathodic protection system 30 may be coupled with subsea structure 34 at a variety of connection terminals (regions) 46, e.g. at exposed metal surfaces that are not coated or at coated surfaces which undergo coating deterioration over time.

Figure 2:
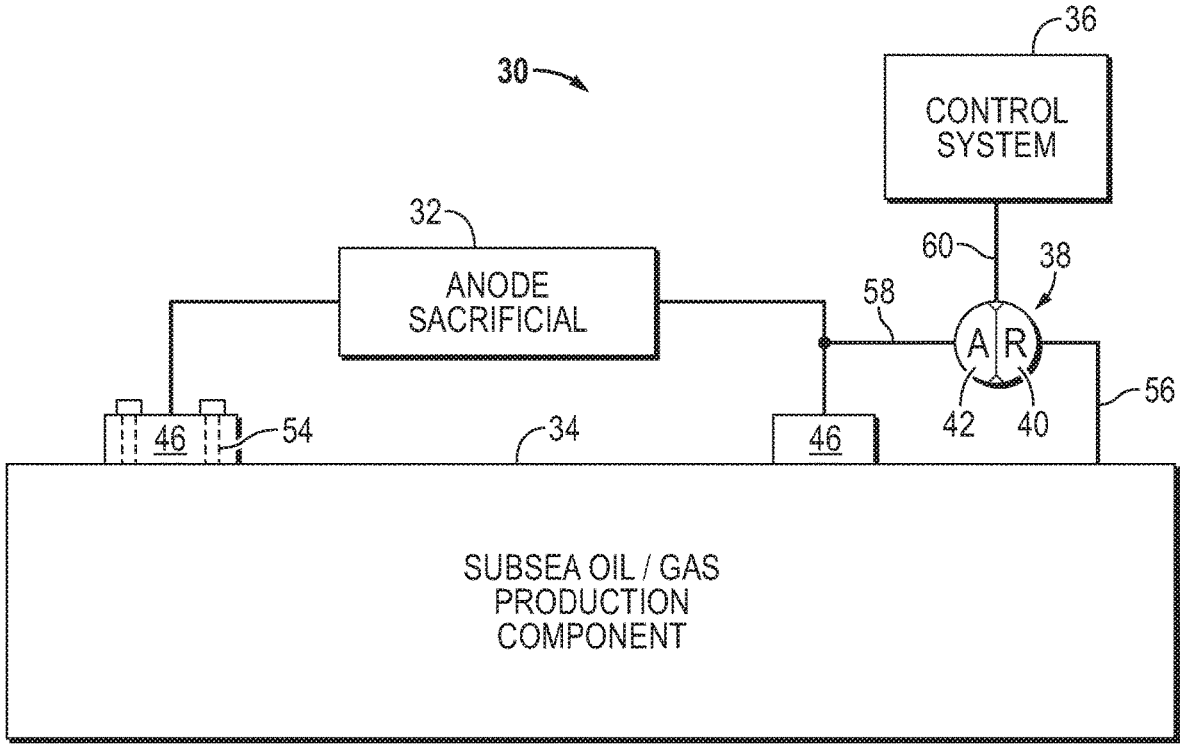
FIG. 2 is a schematic illustration of an example of a sacrificial anode installed on a protected base structure where the connection of the anode to the base metal is bypassed through a resistor that is modulated by a control system, according to an embodiment of the disclosure.

Referring generally to FIG. 2, another embodiment of cathodic protection system 30 is illustrated. As with the previous embodiment, the sacrificial anodes 32 are isolated from the subsea base structure 34 via non-conductive attachments rather than being directly mounted to the protected base structure 34. It should be noted various components are the same or similar to those of the embodiment illustrated in FIG. 1 and have been labeled with common reference numerals.

The control system 36 is again coupled with the sacrificial anode or anodes 32 via control device 38 which may comprise current regulator 40, e.g. variable resistor, and ammeter 42. In this example, one of the connection regions 46 is at a subcomponent bolted to a primary component of the subsea structure 34 via bolts 54. Additionally, a cable 56 is routed from control device 38 and coupled, e.g. welded, to the subsea structure 34 to be protected. A cable 58 also may be routed from control device 38 and coupled, e.g. welded, and sealed to an anode pole of the corresponding sacrificial anode 32. A suitable feedback cable or cables 60 may be routed between control device 38 and control system 36.

The configuration enables a controlled galvanic reaction current to be applied to the subsea structure 34 at connection regions 46 so that the life of the anodes 32 can be extended beyond their conventional life. The system configuration also enables the overall size and weight of the anodes 32 to be reduced while providing the desired/optimal protection for the subsea base structure 34.

By controlling the range of electric potential voltages to, for example, a range between −800 mV and −900 mV (SCE), the risk of oversaturation of hydrogen at exposed metal parts is reduced. For example, the potential oversaturation of hydrogen that sometimes occurs during the kick-off phase of a conventional sacrificial anode system is substantially reduced or eliminated. This can provide a variety of benefits for many applications, including high pressure-high temperature (HPHT) applications where computations of crack growth rate have been shown to be dependent on the cathodic protection potential. Reduced potentials may decrease the crack growth rate and with the reduced growth rate, the geometry, size and thickness of the components of subsea structure 34 can be optimized, e.g. reduced.

Furthermore, controlled current sacrificial anodes may be effective for use in highly anoxic conditions found in certain subsea applications were hydrogen sulfide may attack the base metal structures that are exposed to the seawater. In these types of embodiments, the sacrificial anodes 32 can be tailored to an array of specific conditions and operational parameters.

Figure 3:
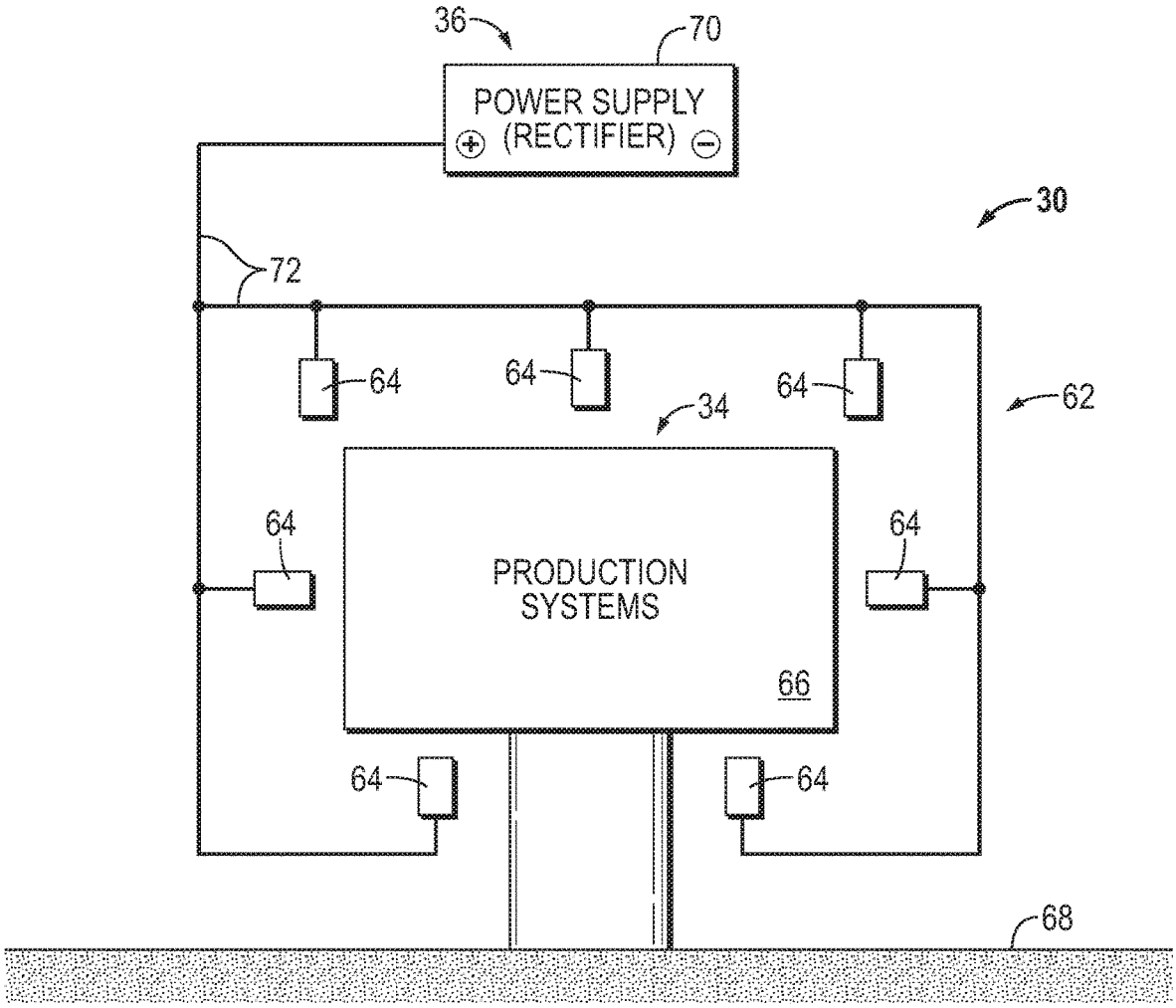
FIG. 3 is a schematic illustration of an example of an impressed cathodic protection system having reference electrodes that can be strategically distributed to specific areas of a subsea structure, according to an embodiment of the disclosure.
Figure 4:
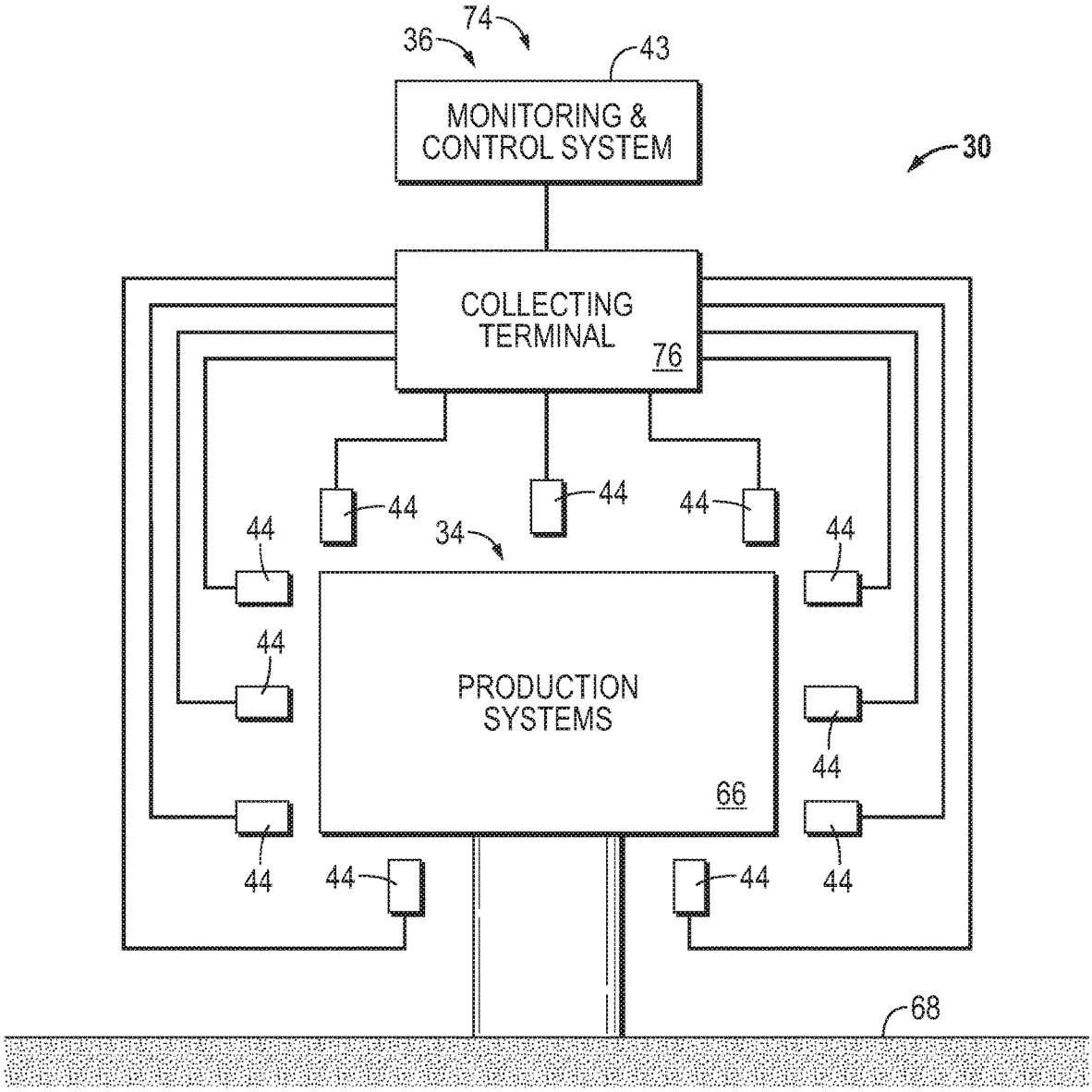
FIG. 4 is a schematic illustration of an example of an impressed current cathodic protection system having anodes that can be strategically distributed to specific areas of a subsea structure, according to an embodiment of the disclosure.
Figure 5:
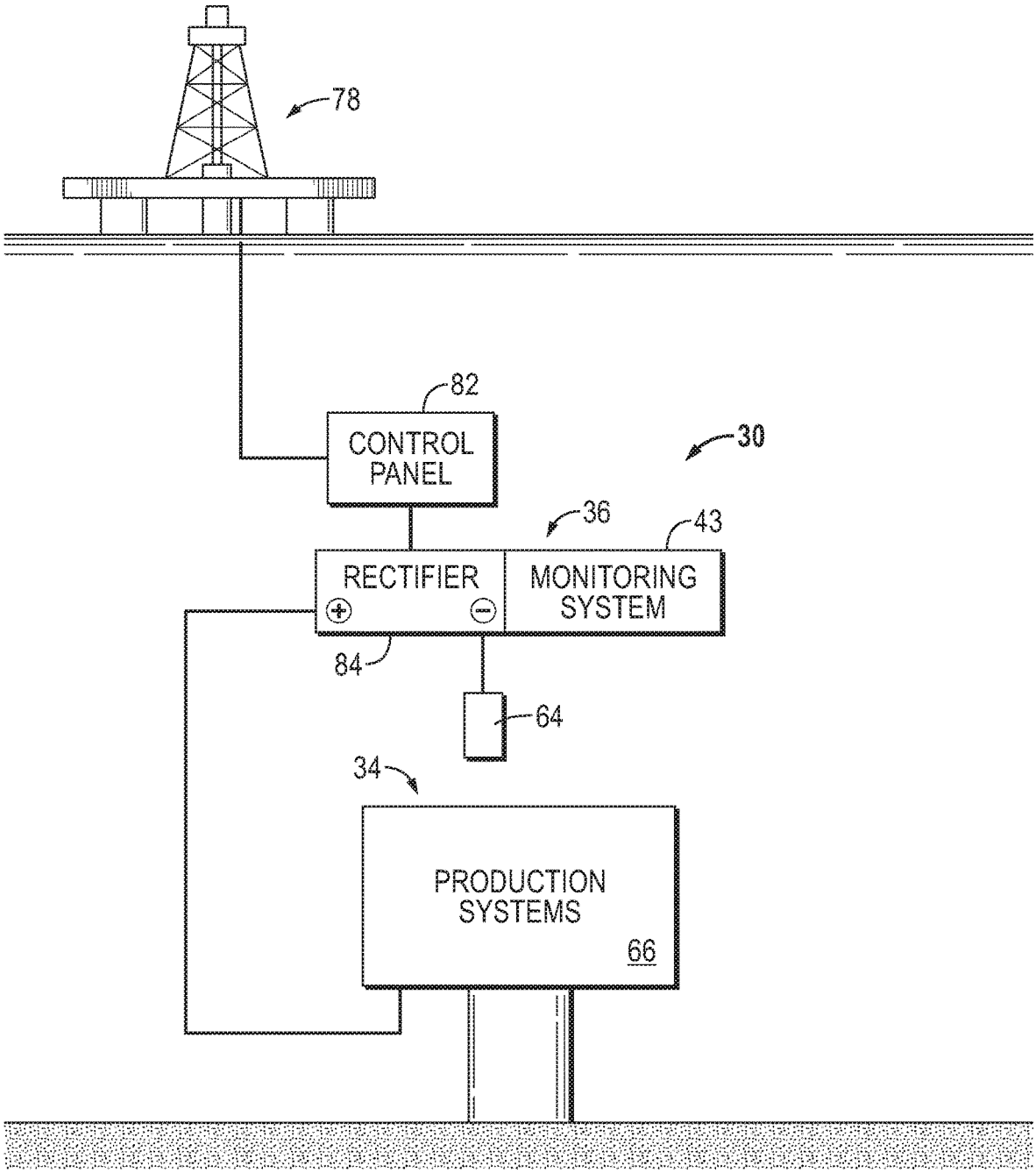
FIG. 5 is a schematic illustration of an example of a closed-loop monitor and control impressed current cathodic protection system that modulates the cathodic protection potential in the range of −850 mV to −950 mV (SCE), according to an embodiment of the disclosure.

Referring generally to FIGS. 3-5, additional embodiments of cathodic protection system 30 are illustrated. In these examples, the cathodic protection systems 30 are in the form of impressed current cathodic protection systems which include the ability for controlling the electric potential. The impressed current cathodic protection systems 30 may be constructed with various combinations of monitoring and control systems used to monitor and control the electric potential to maintain the electric potential in a desired range, e.g. −800 mV to −950 mV (SCE). Managing the distribution of the potentials with distributed anodes, e.g. evenly distributed impressed current anodes, based on data from an integrated monitoring system enables restriction of the excessive generation of hydrogen and mitigation of the effects of hydrogen embrittlement.

In some embodiments, continuous monitoring of the protective passivation potential may be accomplished by a series of permanently installed reference electrodes that measure the metal surface potential and feed it back to the control system, e.g. the programmable logic control system, with the purpose of balancing the current flow to match and maintain the desired protection potential for the metal surface. In this way, premature failure of components (with no discernible material susceptibilities and which are known to be operating under proper stress design constraints) may be reduced.

With additional reference to FIG. 3, the impressed current cathodic protection system 30 comprises a distributed anode system 62 having a plurality of impressed current anodes 64 which are distributed in a desired pattern, e.g. evenly distributed, along the subsea structure 34 which in this example comprises a production system 66 disposed at a seabed 68. The impressed current anodes 64 may be made from materials such as mixed metal oxides, platinum, or other suitable materials. The anodes 64 may be installed on the subsea structure 34 to be protected and may be connected electrically to a suitable control system 36 which may comprise a current power source 70, e.g. a DC current power source. The anodes 64 may be coupled with the power source 70 via suitable anode lines 72. In some embodiments, the power source 70 may comprise or be in the form of a rectifier converting alternating current into direct current.

The placement of impressed current anodes 64 can be tailored to the specific structure 34 and to the types of materials that are to be protected. For example, the anode distribution can be tailored to specific applications by adjusting the anodes 64 to accommodate geometrical complexity of the subsea structure/equipment 34 and to the types of materials that are exposed to the seawater environment.

The flexibility of anode placement enables improved cathode protection in a variety of structures. If, for example, the subsea structure 34 comprises exposed metal in a series of steel tubes, the corresponding anodes 64 can be placed at a greater distance from the tube area when the tubes are formed of stainless steel as opposed to carbon alloy steel. The reason for this is that the minimum protective potential for carbon alloy steel is approximately −800 mV (SCE) while the minimum protective potential for stainless steel is approximately −700 mV (SCE). The ability to provide relatively greater separation of the corresponding anodes 64 from the area being protected allows the balancing of the electric potential to be more closely matched to the material it is protecting.

According to an embodiment, the impressed current anodes 64 may be distributed by considering the areas of the subsea structure 34 which are protected by barrier coatings. The cathodic protection of these areas may be reduced with respect to the protected metal that is exposed to seawater. The deterioration of the protective coating, e.g. paint, may be calculated to estimate the amount of additional current draw and hence anode material that should be used. Effectively, this means the density of anode placement in these areas can be substantially reduced. Depending on the application, a monitoring system 43 may comprise a plurality of suitable reference electrodes 44 laced at desired locations along the subsea structure 34 (see FIG. 4).

Referring generally to FIG. 4, another embodiment of impressed current cathodic protection system 30 is illustrated. In this embodiment, the control system 36 and monitoring system 43 have been integrated into a combined monitoring and control system 74. The combined monitoring and control system 74 is coupled with a common collection terminal 76 which, in turn, is coupled with a plurality of reference electrodes 44. The data obtained from reference electrodes 44 is thus provided to the collection terminal 76 which can relay signals to the monitoring and control system 74 for interpretation via, for example, a programmable logic controller. Based on this analysis, appropriate currents may be output to suitable impressed current anodes 64 (see FIG. 3).

The function of the reference electrodes 44 in this embodiment is to monitor the potential in areas of interest and to use that data to balance or compensate in achieving a desired electric potential goal. By way of example, the reference electrodes 44 may be copper/copper sulfate or silver/silver chloride or other suitable materials. In various applications, the desired overall protection potential goal for this type of system 30 is between −800 mV and −950 mV (SCE) which corresponds to the electric potential for carbon alloy steel and covers the potential of other materials that may be used in a variety of subsea structures 34.

Referring generally to FIG. 5, another embodiment of impressed current cathodic protection system 30 is illustrated. In this example, current may be provided from the surface, e.g. from a surface platform 78. By way of example, the current may be delivered as AC current via an umbilical 80 routed to a subsea control panel 82. The control panel 82 is coupled with control system 36 which may comprise a rectifier 84, e.g. a waterproof rectifier, able to convert the AC current to suitable DC current. In the illustrated example, the control system 36 also is coupled with monitoring system 43 and with at least one impressed current anode 64, e.g. a plurality of impressed current anodes 64, arranged at suitable locations along subsea structure 34.

Figure 6:
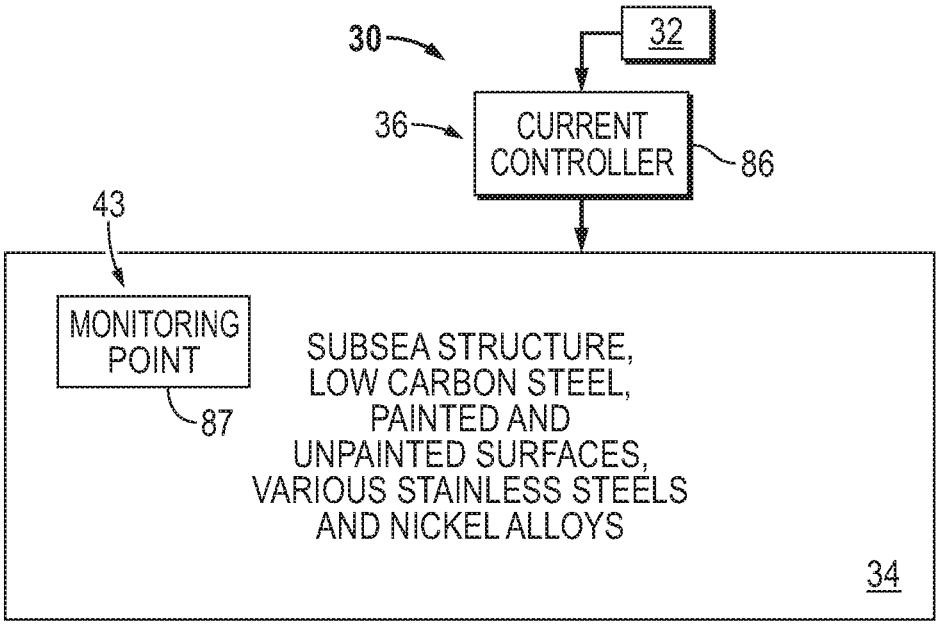
FIG. 6 is a schematic illustration of an example of a sacrificial anode system incorporating a controller that regulates current to a preset current limiting level lower than −1050 mV (SCE), according to an embodiment of the disclosure.

Referring generally to FIG. 6, another embodiment of cathodic protection system 30 is illustrated. In this example, at least one sacrificial anode 32 is placed in communication with the subsea structure 34 via a simple control system 36 in the form of a current controller 86. Effectively, the system combines smart anodes 32 with current limiting controllers 86. Each current controller 86 regulates current from the corresponding anode 32 to a preset level lower than, for example, the standard −1050 mV before connecting directly to base metal of the subsea structure 34 at a specific connection terminal location 46. The base metal of the connection location 46 receives the passivation current.

Depending on the application, the subsea structure 34 may be constructed from various types of materials, such as low carbon steel having painted and unpainted surfaces as well as stainless steels and nickel alloys. The anode 32 may be formed from suitable materials, such as aluminum-indium. In this example, the current controller 86 may be a current regulator in the form of, for example, a resistor or a semiconductor and it may be battery-powered or powered from potential differential. In some applications, this embodiment also may comprise monitoring system 43 having one or more monitoring locations 87, e.g. monitoring points. Each monitoring location may have, for example, a reference electrode 44 or other suitable sensor able to provide feedback to the current controller 86 or to another portion of an overall control system 36.

Figure 7:
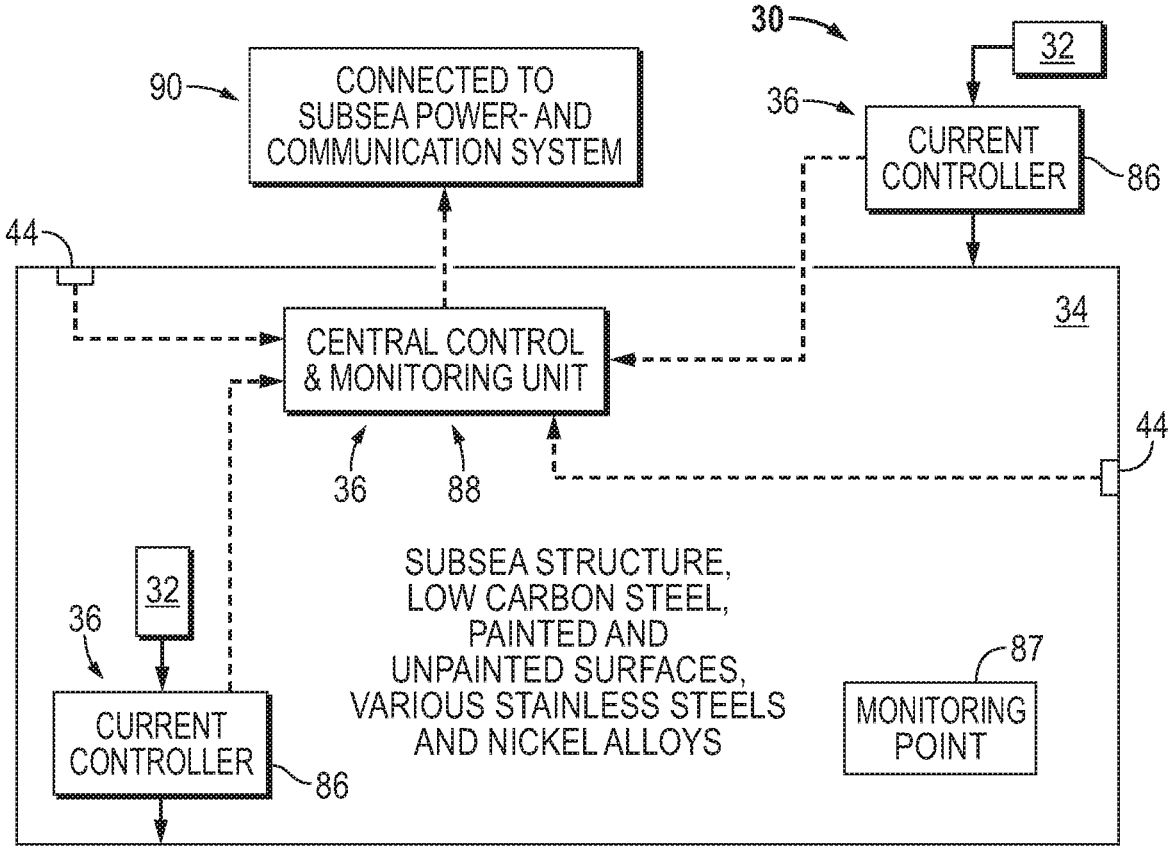
FIG. 7 is a schematic illustration of an example of a sacrificial anode system in conjunction with a controller and a monitoring system, according to an embodiment of the disclosure.

Referring generally to FIG. 7, another embodiment of cathodic protection system 30 is illustrated. In this example, at least one sacrificial anode 32, e.g. a plurality of sacrificial anodes 32, may be placed in communication with the subsea structure 34 via control system 36. However, this embodiment of control system 36 comprises current controllers 86 which work in cooperation with corresponding anodes 32 and are communicatively coupled with a central control and monitoring unit 88. The central control and monitoring unit 88 may be placed in communication with, for example, a subsea power and communication system 90.

The central control and monitoring unit 88 collects data from the current controllers 86 and can be a standalone unit or integrated with other components. Depending on the application, the central control and monitoring unit 88 may be located on the corresponding subsea structure 34, on another subsea structure, or at other suitable locations.

In this embodiment, the monitoring system 43 comprises a plurality of sensors 44, e.g. reference electrodes, which are placed at desired locations, e.g. at uncoated components, to measure the cathodic potential at those locations. The data is then transmitted to the monitoring unit portion of the central control and monitoring unit 88. Depending on the application, the central control and monitoring unit 88 may perform some or all of the data processing. However, the central control and monitoring unit 88 may be used as a collection unit that gathers the readings from the various reference electrodes 44 and transmits this data to the subsea power and communication system 90 for further processing. In some embodiments, the data may be further transferred to a top side terminal where the readings/data are collated, processed, and/or made available for review. It should be noted that some embodiments may utilize anodes 32 in the form of low voltage anodes.

Effectively, the system illustrated in FIG. 7 combines smart anodes 32 with pre-set current limiting controllers 86 and cathodic protection monitoring capability via monitoring system 43. As with the previous embodiment, each current controller 86 may be constructed to regulate current from the corresponding anode 32 to a preset level lower than, for example, the standard −1050 mV (SCE) before connecting directly to base metal of the subsea structure 34 at a specific connection location 46. The base metal of the connection location 46 receives the passivation current.

Depending on the application, the subsea structure 34 may similarly be constructed from various types of materials, such as low carbon steel having painted and unpainted surfaces as well as stainless steels and nickel alloys. The anodes 32 may be formed from suitable materials, such as aluminum-indium. In this example, the current controller 86 may be a current regulator in the form of, for example, a resistor or a semiconductor and it may be battery-powered or powered from potential differential. The central control and monitoring unit 88 and the subsea power and communication system 90 may comprise various processing capability utilizing programmable logic controllers, microprocessors, or other types of processors.

Figure 8:
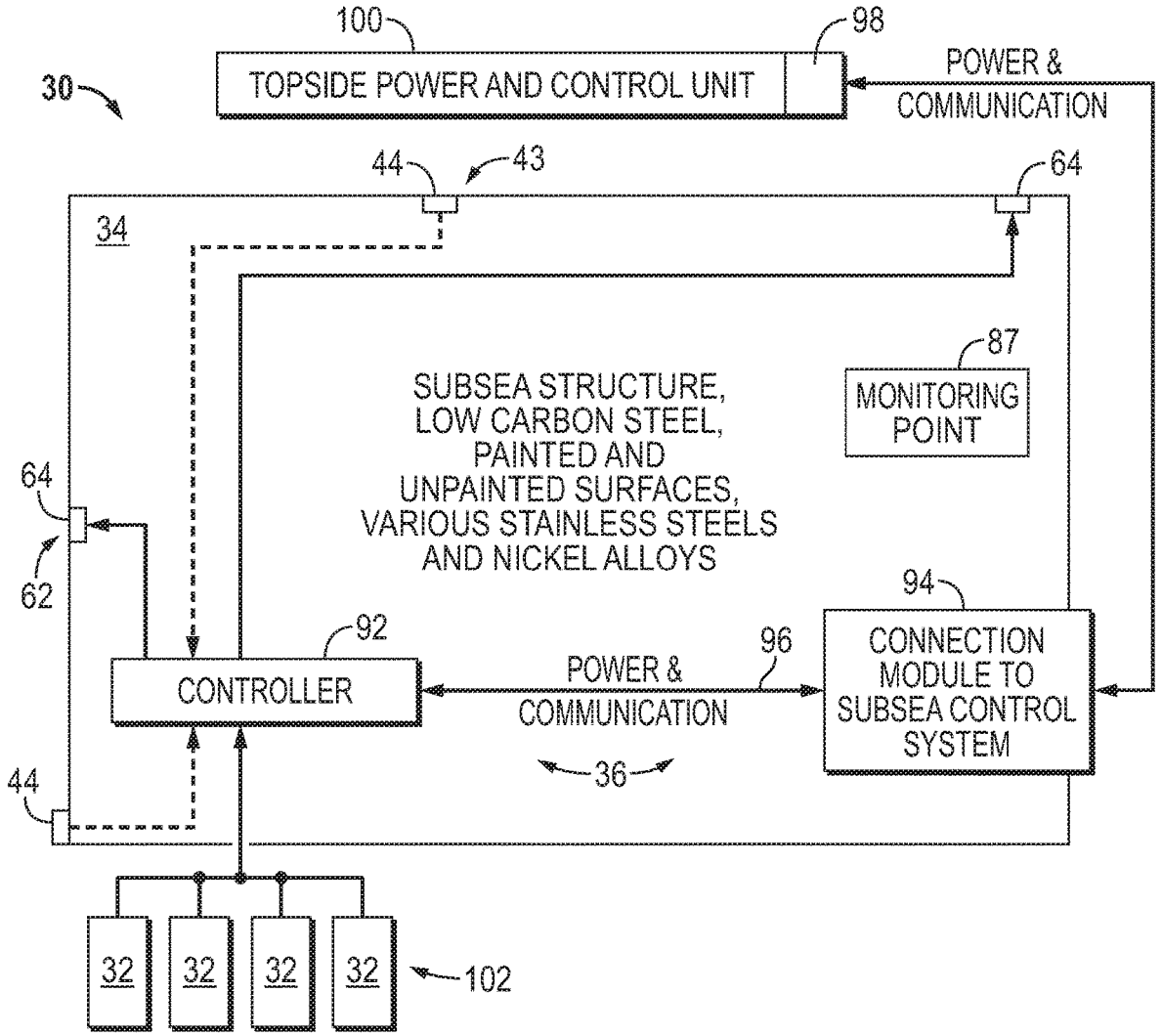
FIG. 8 is a schematic illustration of an example of an impressed current cathodic protection system with monitoring and control functionality that is connected to a bank of sacrificial anodes (acting as a galvanic battery) to provide power in interim installation and as a fail-safe in case of power outages, according to an embodiment of the disclosure.

Referring generally to FIG. 8, another embodiment of cathodic protection system 30 is illustrated. Effectively, the system 30 is in the form of an impressed current system with cathodic protection monitoring capability and a failsafe system utilizing at least one sacrificial anode, e.g. a bank of sacrificial anodes. In this example, the control system 36 may comprise a subsea controller 92 coupled with, for example, a connection module 94 via a power and communication line 96, e.g. a cable. The subsea controller 92 may be in the form of a programmable logic controller, microprocessor-based controller, or other suitable controller.

The connection module 94 also is coupled with a power source 98 which may be part of a topside power and control unit 100. The power source 98 may be in the form of a DC power source located topside for driving current that will be supplied to the subsea controller 92 and distributed out to impressed current anodes 64 positioned at desired locations along subsea structure 34. By way of example, the impressed current anodes 64 may be platinum/ceramic composite anodes or other suitable anodes to which a regulated current is supplied via subsea controller 92. In this embodiment, sensors system 43 comprises a plurality of sensors 44, e.g. reference electrodes, to provide data to the subsea controller 92, thus enabling the subsea controller 92 to provide the appropriate current output to impressed current anodes 64.

In operation, DC power is supplied by power source 98 and distributed to the subsea connection module 94. The connection module 94 is able to direct the DC power to subsea controller 92 which may be a programmable logic type controller or other suitable controller. The subsea controller 92 functions to control or adjust the current supplied to the impressed current anodes 64. The adjustments to current are made in accordance with feedback received by the subsea controller 92 from the sensors 44, e.g. reference electrodes. The reference electrodes 44 may be distributed to important areas of the subsea asset 34, e.g. areas with uncoated components such as fasteners, control line tubing, or other exposed metal areas.

In this example, the reference electrodes 44 monitor the cathodic protection potential levels and feedback the results/ data to the subsea controller 92. The subsea controller 92 receives these inputs and controls the current levels to attain and moderate cathodic protection levels in a desired range, e.g. within −800 mV to −950 mV, at the impressed current anodes 64. The impressed current anodes 64 distribute current to the base material of the subsea structure 34 being protected so as to produce appropriate cathodic protection levels as determined by, for example, preset levels programmed into the subsea controller 92.

In this embodiment, a failsafe mode is provided by at least one sacrificial anode 32, e.g. a bank 102 of anodes 32 which are isolated from the base subsea structure 34 and electrically coupled with subsea controller 92. The sacrificial anodes 32 act as a failsafe cathodic protection system if power is cut off, e.g. cut off during the subsea installation stage of the equipment, or before electrical power is provided. In these types of situations, the subsea controller 92 is able to close the circuit with the sacrificial anodes 32 and the subsea structure 34 to continue providing cathodic protection in the absence of power provided from power source 98.

This type of cathodic protection system 32 provides a closed loop monitoring and control system. Additionally, the impressed current anodes 64 may be constructed with relatively small sizes and distributed to a large number of desired areas of subsea structure 34 to ensure the desired level of cathodic protection throughout the structure. It should be noted that in a related type of embodiment, the sacrificial anodes 32 may be in the form of low voltage anodes.

Figure 9:
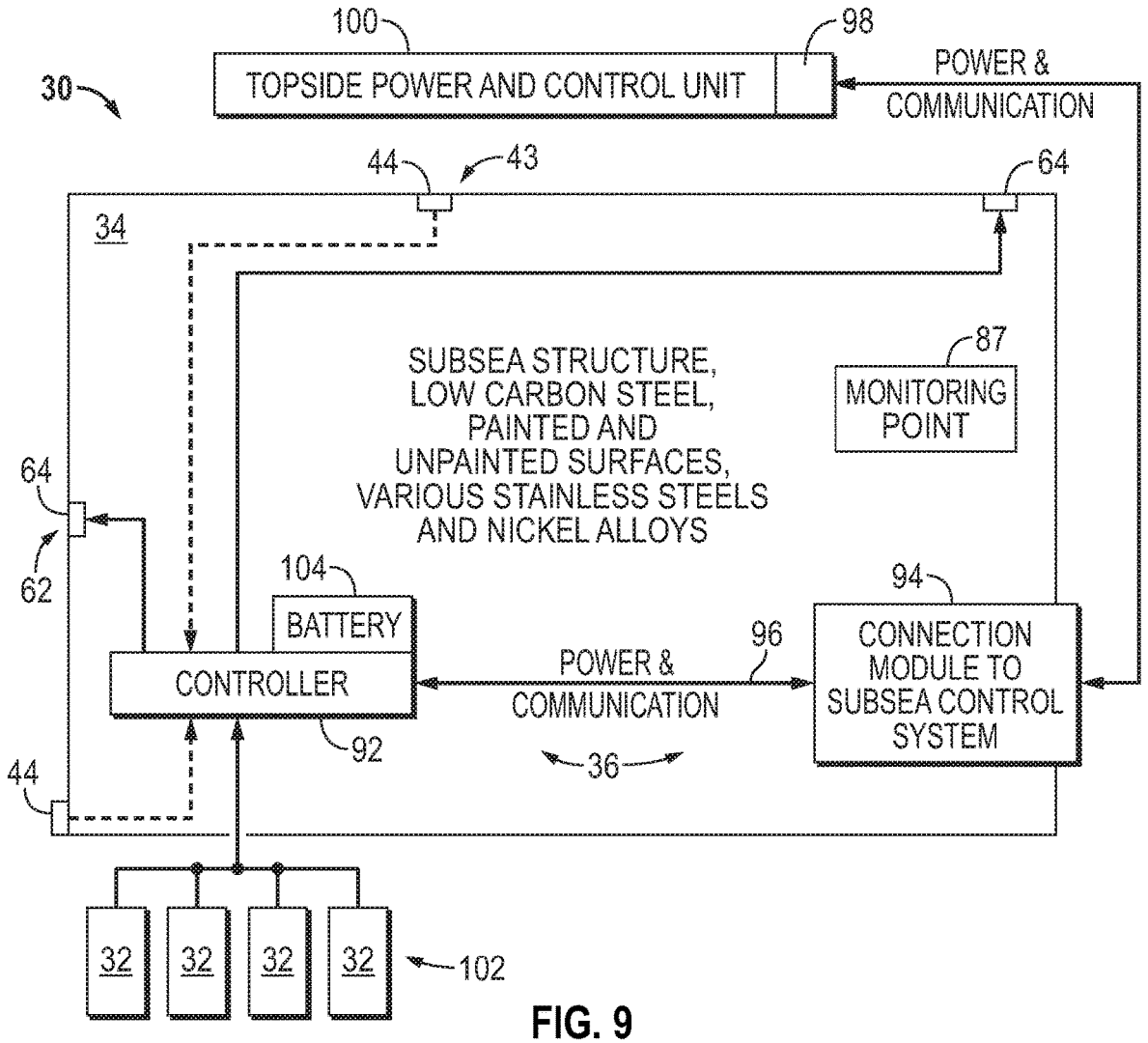
FIG. 9 is a schematic illustration of an example of an impressed current cathodic protection system with monitoring and control functionality that adds a battery to the controller which, in turn, is connected to a bank of sacrificial anodes (allowing a galvanic battery to charge the controller in case of power outages), according to an embodiment of the disclosure.

Referring generally to FIG. 9, another embodiment of cathodic protection system 30 is illustrated. This embodiment is similar in structure and function to the embodiment described above with reference to FIG. 8. However, a backup battery 104 is in electrical communication with the subsea controller 92 to ensure the subsea controller 92 remains powered even if power is temporarily unavailable from the power source 98. In this example, the anodes 32 of anode bank 102 are illustrated as being in the form of low voltage anodes.

Figure 10:
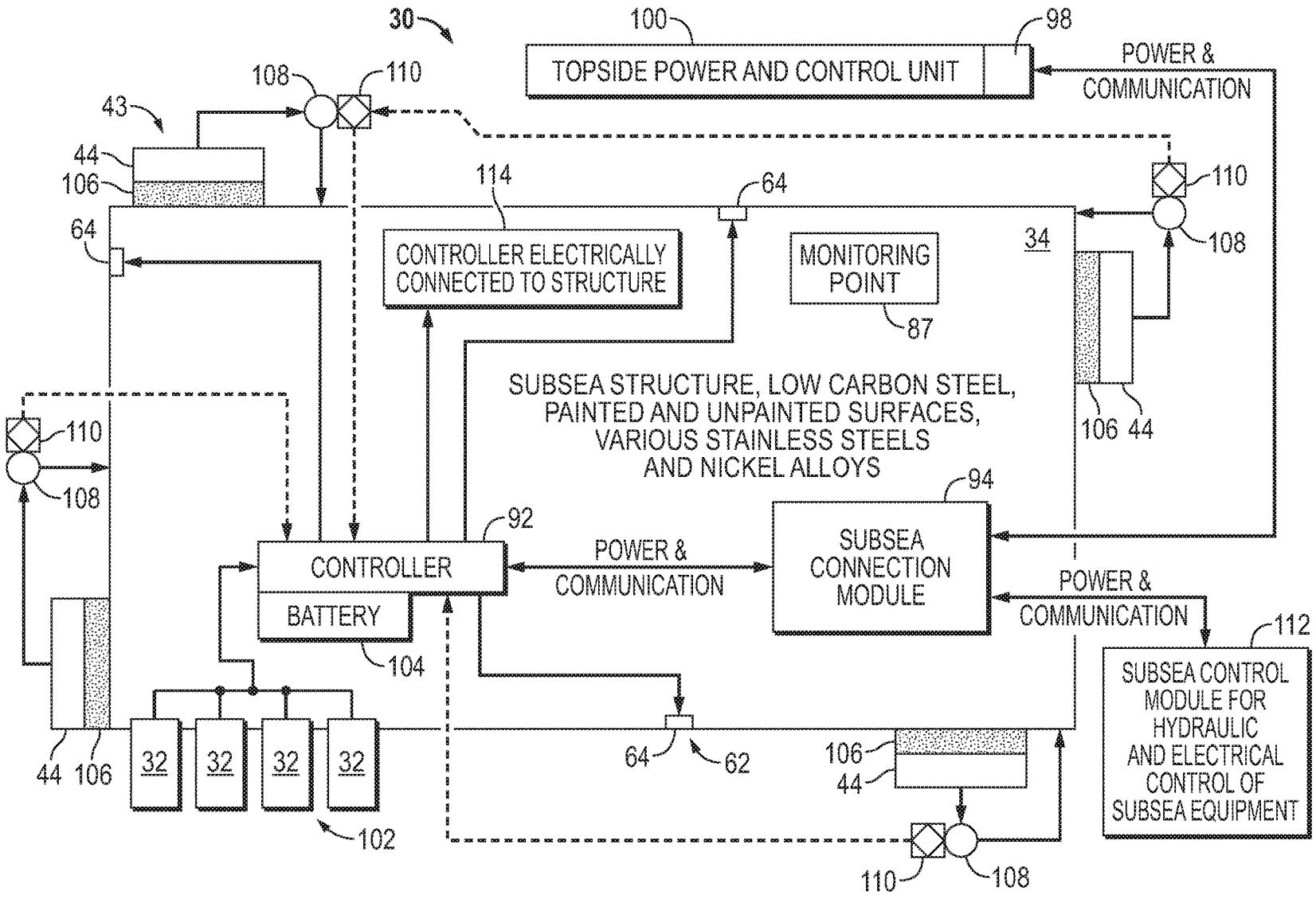
FIG. 10 is a schematic illustration of an example of a sacrificial anode monitoring and control closed-loop cathodic protection system that adds a battery to the control system for power outage interruptions plus a fail-safe option where a bank of sacrificial anodes (acting as a galvanic battery) can recharge the battery or provide backup power, according to an embodiment of the disclosure.

Referring generally to FIG. 10, another embodiment of cathodic protection system 30 is illustrated. In this example, features which are similar to or the same as features found in embodiments described above have been provided with the same reference numerals. As illustrated, the sensor system 43 may comprise a plurality of reference electrodes 44 placed at desired locations along the subsea structure 34 and isolated from the subsea structure 34 via isolation pads 106 or other suitable isolation techniques.

In some embodiments, each reference electrode 44 may be coupled with a voltage sensor 108 and a microcontroller 110. By way of example, each microcontroller 110 may be a simple integrated circuit or other type of simple controller which is able to communicate with the subsea controller 92.

In the embodiment illustrated, the subsea connection module 94 is coupled to both power source 98 of topside power and control unit 100 as well as to a subsea control module 112. The subsea control module 112 may be operated via subsea controller 92 to provide hydraulic and/or electrical inputs to corresponding subsea equipment.

The embodiment illustrated shows a failsafe anode bank 102 having, for example, aluminum-indium anodes 32 which can serve as a backup system in the event power to the subsea controller 92 his lost and backup battery 104 his discharged. The subsea controller 92 may be programmed with a failsafe mode whereupon loss of power from power source 98 triggers electrical connection of the anode bank 102 with the subsea structure 34 via impressed current anodes 64 and/or a separate electrical connection 114. In some embodiments, however, the anode bank 102 may comprise anodes 32 in the form of low voltage anodes.

The subsea controller 92 may be programmed to process feedback data from sensors 44 and, based on that data, to maintain cathodic protection at impressed current anodes 64 in a range from about −800 mV to −950 mV (SCE). As with other embodiments, the sensors/reference electrodes 44 may be placed at desired/important areas to monitor the cathodic protection potentials and to feed back the results to the subsea controller 92. The subsea controller 92, in turn, is able to adjust a current regulator, e.g. a current limiter, to modulate current flow while also feeding back the sensor data to the subsea connection module 94.

As with other embodiments described herein, the subsea controller 92 is able to utilize the data obtained via sensors 44 to control voltage levels applied to the subsea structure 34 so as to attain and modulate cathodic protection levels within a desired range at desired locations along the subsea structure 34. It should be noted the subsea connection module 94 also may be used to gather data from associated electrical and/or hydraulic equipment so that cathodic protection data and overall system data may be provided to the topside power and control unit 100. During normal operation, the power and control unit 100 feeds power to the subsea connection module 94 and collects performance data from associated cathodic protection equipment and/or other subsea equipment.

Establishing a range of protection potential voltages between, for example, about −800 mV and −950 mV (SCE) limits the exposure of exposed metal parts to a condition of oversaturation of hydrogen. The potential oversaturation of hydrogen during, for example, the kick-off phase of a sacrificial anode system can result in various types of hydrogen embrittlement failures. Limiting the protection potential voltages also may result in less production of calcareous deposits. Although calcareous deposits may be beneficial in some applications, they can also clog connector systems and subsea installations.

In various embodiments, permanently installing reference electrodes 44 that can be fed back to a suitable control system, e.g. subsea controller 92, enables monitoring and adjustment of the electric potential to a desired protective level or levels. The interrelationship between the distributed, e.g. uniformly distributed, anodes 32, 64 and the positioning of the reference electrodes 44 facilitates tailored coverage for a variety of equipment in the subsea structure 34. For example, some areas of a subsea tree, subsea manifold, or other type of subsea structure 34 may have more bare metal, e.g. tubing or bolts, than other areas that are fully protected by barrier coatings. The bare-metal areas can be designed to operate at a higher protective potential while the barrier protected areas can be designed at the lower range of the protective potential.

Moreover, impressed current cathodic protection system 30 may be constructed with smaller, lower weight impressed current anodes 64 which both lowers the weight of the overall system and enables greater flexibility with respect to locating the anodes 64 relative to traditional sacrificial anodes. The distributed anodes 64 of various impressed current cathodic protection systems 30 also may have extended lives compared to conventional systems.

Depending on the parameters of a given application and a given environment, the specific structure of cathodic protection system 30 may vary substantially. For example, various types of sacrificial anodes and impressed current anodes may be used individually or in various combinations. Additionally, the control system 36 may comprise various types of controllers, e.g. programmable logic controllers, variable resistors, microprocessor-based controllers, and/or other controllers used alone or in combination to provide individualized cathodic protection levels at specific locations. The location of the subsea controller or controllers also may vary. In some applications, the subsea controller 92 or other controller components may be located directly on the subsea structure 34 or they may be positioned on other equipment or at other suitable locations.

Furthermore, the number and layout of the anodes, e.g. impressed current anodes 64, as well the layout of the sensors 44, e.g. reference electrodes, may vary substantially depending on the size, configuration, materials used, and other aspects of the subsea installation 34. Various embodiments of the cathodic protection system 30 also may be used in other types of subsea applications and/or surface applications, including subsea drilling applications, subsea structure applications, and subsea pipeline applications. The ability to precisely monitor and control cathodic protection levels, thus reducing the formation of hydrogen, also may reduce certain design constraints. For example, some subsea structures 34 may be constructed with thinner, lighter components (compared to conventional systems) because the potential for hydrogen embrittlement of the components is substantially reduced.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A method for providing subsea corrosion protection, comprising:

determining at least one electrical potential at at least one reference electrode disposed at at least one location along a subsea structure formed at least in part of steel;

comparing, using a controller, the at least one electrical potential to at least one preset limit;

determining current load to the subsea structure;

based on the comparing of the at least one electrical potential to the at least one preset limit, and the current load to the subsea structure, adjusting, using a variable resistor, current flow from a sacrificial anode to specific connection regions disposed at a variety of locations on the subsea structure to attain and modulate a cathodic protection level within a range of −800 millivolts (mV) to −950 mV;

providing current to the controller at a subsea location via a topside power source; and supplying current to the controller from a backup power supply to operate the controller to control voltage levels applied to the subsea structure and maintain cathodic protection levels between −800 mV and −950 mV in the absence of power from the topside power source;

wherein the backup power supply is a subsea anode bank.

2. The method as recited in claim 1, wherein the determining of the at least one electrical potential at the at least one reference electrode comprises utilizing a plurality of sensors coupled along the subsea structure.

3. The method as recited in claim 1, wherein the adjusting, using the variable resistor, of the current flow to the sacrificial anode causes outputting current to a plurality of impressed current anodes mounted at locations on the subsea structure.

4. The method as recited in claim 1, further comprising coupling the controller with the at least one reference electrode used to determine the at least one electrical potential.

5. The method as recited in claim 1, further comprising forming the sacrificial anode from an aluminum-indium alloy.

6. The method as recited in claim 1, further comprising configuring the controller as a programmable logic controller (PLC).

7. The method as recited in claim 4, further comprising using the at least one reference electrode to comparatively monitor a system passivation potential against a known standard.

8. A method, comprising:

determining cathodic protection potential at a plurality of locations on a subsea structure comprising metal;

comparing the cathodic protection potential to a preset limit;

determining current load to the subsea structure;

based on the comparing of the cathodic protection potential to the present limit, and the current load to the subsea structure, modulating, using a subsea control system, current delivered to the subsea structure to maintain a protective potential between about −800 mV and about −950 mV at desired locations of the subsea structure;

providing current to the controller at a subsea location via a topside power source; and supplying power to the controller from a backup subsea anode bank to operate the controller to control voltage levels applied to the subsea structure and maintain cathodic protection levels between −800 mV and −950 mV in the absence of power from the topside power source.

9. The method as recited in claim 8, wherein using the subsea control system comprises controlling delivery of the current to a plurality of impressed current anodes.

10. The method as recited in claim 8, wherein the determining of the cathodic protection potential comprises using a plurality of reference electrodes.

11. The method as recited in claim 8, wherein the current delivered to the subsea structure is sufficient to passivate the metal of the subsea structure.

* * * * *